US009498097B2

(12) United States Patent
Grant

(10) Patent No.: US 9,498,097 B2
(45) Date of Patent: Nov. 22, 2016

(54) PORTABLE TOILET SEAT ADAPTER WITH AN INTEGRATED CARRYING CASE

(71) Applicant: Linda F. Grant, Bakersfield, CA (US)

(72) Inventor: Linda F. Grant, Bakersfield, CA (US)

( * ) Notice: Subject to any disclaimer, the term of this patent is extended or adjusted under 35 U.S.C. 154(b) by 0 days.

(21) Appl. No.: 14/744,023

(22) Filed: Jun. 18, 2015

(65) Prior Publication Data

US 2015/0366417 A1 Dec. 24, 2015

Related U.S. Application Data

(60) Provisional application No. 62/013,539, filed on Jun. 18, 2014.

(51) Int. Cl.
*A47K 13/00* (2006.01)
*A47K 13/06* (2006.01)

(52) U.S. Cl.
CPC ..... *A47K 13/06* (2013.01); *A47K 13/00* (2013.01)

(58) Field of Classification Search
CPC ..... A47K 13/06
USPC ..... 4/237–241
See application file for complete search history.

(56) References Cited

U.S. PATENT DOCUMENTS 2,133,626 A * 10/1938 Mayberry ..... A61M 3/0266 4/239
2,443,068 A 6/1948 Dahle
2,457,726 A * 12/1948 Richards ..... A47K 13/06 4/239
3,371,356 A * 3/1968 Burton ..... A47K 13/06 4/239
4,516,279 A * 5/1985 Block ..... A47K 13/06 4/235
4,525,880 A * 7/1985 Bass ..... A47K 13/14 297/221
D305,793 S * 1/1990 Cronk ..... A47K 13/14 D23/311
5,005,223 A * 4/1991 Greenwood ..... A47K 13/06 4/235
5,090,063 A * 2/1992 Edwards ..... A47K 13/14 206/225
5,267,355 A * 12/1993 Landman ..... A47K 13/02 4/237
5,974,598 A * 11/1999 Granda-Cabrera .... A47K 11/02 4/239
6,175,968 B1 * 1/2001 Schneider ..... A47K 13/005 4/239
6,389,612 B1 * 5/2002 Harris ..... A47K 13/06 4/239

(Continued)

*Primary Examiner* — Lori Baker
(74) *Attorney, Agent, or Firm* — Law Office of Dorian Cartwright; Dorian Cartwright

(57) ABSTRACT

A portable toilet seat adapter (100) can size down a stationary toilet to a child size and also provide a sanitary barrier. The seat adapter (100) comprises a carrying case (105) and an open-front toilet seat (120) in a U-shape. The toilet seat (120) folds in a catty-corner position for size reduction and then folds into the carrying case (105). Living hinges are rotatable hinges integrated in the toilet seat (120) so that the toilet seat (120) can be formed from a single molding. Also, living hinges are integrated between a lid (110) for rotation around a base (130) and the carrying case (105) can be formed from a single mold. Fasteners that close the carrying case (105) can also be living hinges and formed from the same single mold as the carrying case (105).

15 Claims, 11 Drawing Sheets

(56) References Cited

U.S. PATENT DOCUMENTS

| | | | | | |
|---|---|---|---|---|---|
| D502,766 | S * | 3/2005 | Nash | A45C 11/00 | D23/311 |
| D559,368 | S * | 1/2008 | Grant | A47K 13/06 | D23/311 |
| 8,397,915 | B2 * | 3/2013 | Davidson | A45C 11/00 | 119/161 |
| 8,893,316 | B1 * | 11/2014 | Smith | A47K 17/026 | 4/239 |
| 2002/0104155 | A1 * | 8/2002 | Merry | A47K 13/06 | 4/239 |
| 2013/0074253 | A1 * | 3/2013 | Green | A47K 13/005 | 4/239 |
| 2013/0212793 | A1 * | 8/2013 | Hand | A47K 13/06 | 4/235 |

* cited by examiner

PORTABLE TOILET SEAT ADAPTER WITH AN INTEGRATED CARRYING CASE

CROSS-REFERENCE TO RELATED APPLICATIONS

This application claims the benefit of priority under 35 U.S.C. 119(e) to U.S. Application No. 62/013,539, filed Jun. 18, 2014, entitled TRAVEL CHILD ADAPTER SEAT FOR RESTROOMS, by Linda Grant, the contents of which are hereby incorporated by reference in its entirety.

FIELD OF THE INVENTION

The invention relates generally to a toilet seat adapter, and more specifically, to a portable toilet seat adapter with an integrated carrying case for use on a stationary toilet.

BACKGROUND OF THE INVENTION

Parents and caretakers of children can have an unpleasant experience while potty training a toddler.

First, toilet seats are not adapted for the smaller body frame of toddlers. Without a smaller base, the child does not have proper support to the sides of a commode. Secondly, restrooms, and public restrooms in particular, are known to fester germs and viruses. Many currently available products carry the germs and viruses after use in various public restrooms. Moreover, many currently available products are not compactable in order to drastically reduce the size of the travel toilet, as carried. Additionally, currently available products that fold for a reduction in size are dangerous because a child's skin can get pinched in the hinges, for example, with screws.

It is desirable to overcome these shortcomings.

SUMMARY

To meet the above-described needs, a portable toilet seat adapter with an integrated carrying case, and associated methods and methods of manufacture, are described.

In a first embodiment, a portable toilet seat adapter (100) comprises a carrying case (105) and an open-front toilet seat (120). In an embodiment, the carrying case (105) includes a lid (110) having a front (111A) and a rear (111B), a base (130) having a front (113A) and a rear (113B), at least one fastener (112A-C) that couples the lid rear (111B) and to the base rear (1113B) to close the carrying case (105), and a first living hinge (115) that rotatably couples the lid front (111A) to the base front (113A).

In another embodiment, an open-front toilet seat (120) in a U-shape, the open-front toilet seat (120) includes a front portion (122A, 124A) having an open end of the U-shape and fitting over a corresponding front portion of the stationary toilet seat, a rear portion (122B, 124B) having the closed end of the U-shape and fitting over a corresponding rear portion of the stationary toilet seat, a stationary hinge (115) to rotatably couple the rear portion (122B, 124B) of the U-shape to the base (130) of the carrying case (105), and at least a second living hinge (125A, B) to allow the open-front toilet seat (120) to fold in a catty-corner position to fit into the carrying case (125) to close with the at least one fastener (112A-C), the open-front toilet seat (120) being larger than the carrying case (125) when unfolded.

Advantageously, the travel potty protects children from germs and bacteria on public toilet seats. A compact size and light weight makes the travel potty easy to grab and carry on the go. Parent and caregivers no longer need to be stressed and anxious over how to accommodate a child in public when needing to use a restroom. Air vents can be popped open while the travel potty remains in a closed position, in order to prevent dampness and germs. A no pinch factor makes the travel potty safe for children to continue potty training. A glow in the dark version allows the travel potty to be easily located even in dark environments, such as the trunk of an automobile. A hook can be added to the case to allow the travel potty to open up vertically, for example, from the door hook on a nearby door or wall. The travel potty is composed of sanitary, antiviral material. Therefore, adults can use a standard sized travel potty for sanitary reasons alone. These are just exemplary advantages and configurations.

BRIEF DESCRIPTION OF THE FIGURES

In the following drawings, like reference numbers are used to refer to like elements. Although the following figures depict various examples of the invention, the invention is not limited to the examples depicted in the figures. For example, dimensions shown within the machine drawings can be modified within the spirit of the present invention.

FIG. 2B-1-2B-6 are machine drawings of a top view and side views of a case bottom of the travel potty, according to one embodiment.

FIG. 3 is a flow chart illustrating a method for deploying and retracting the travel potty, according to one embodiment.

DETAILED DESCRIPTION

I. Overview of a Portable Toilet Seat Adapter

A portable toilet seat adapter with an integrated carrying case "travel potty", and associated methods and methods of manufacture, are described herein in further detail. The travel potty can be used to adapt commercial or home toilet stationary toilet seats of various shapes. Conveniently, the travel potty has a folding seat that can be folded to fit within a compact carrying case that is integrally attached to the folding seat. One of ordinary skill in the art will recognize variations of the examples given within, that are within the scope of the disclosure.

Figure 1A:
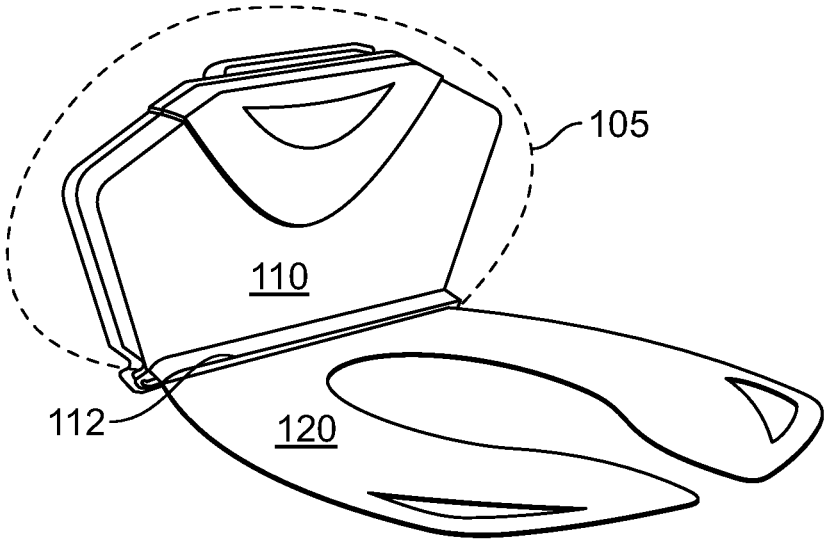
FIG. 1A is a perspective view illustrating a portable toilet adapter seat with an integrated carrying case in an open position, according to some embodiments.
Figure 1B:
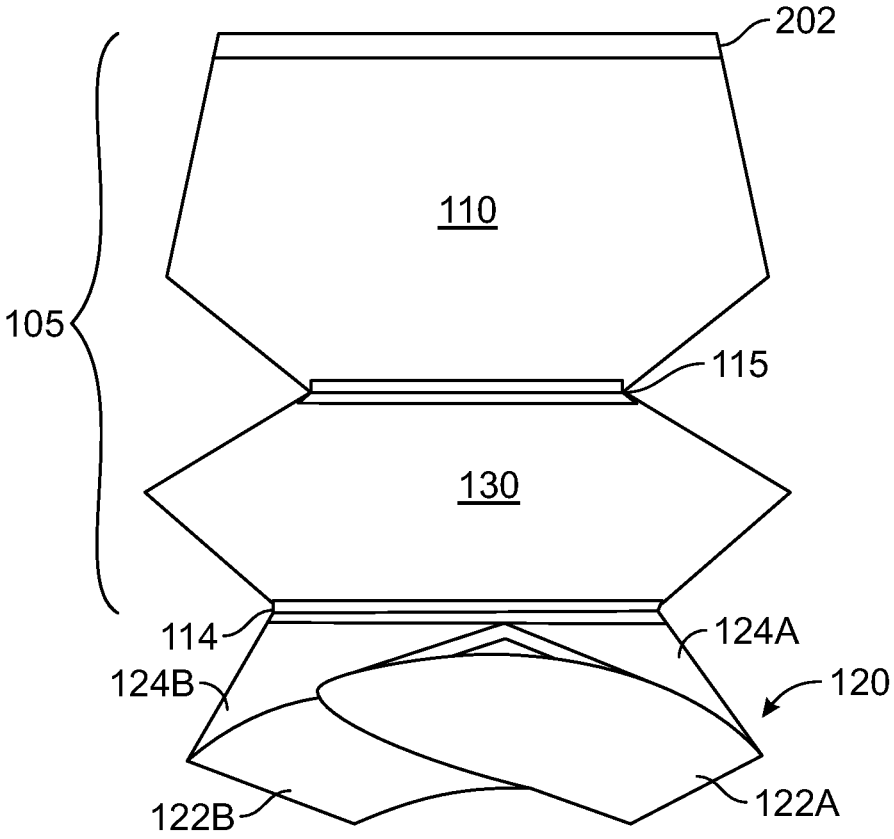
FIG. 1B is a perspective view illustrating a portable toilet adapter seat with an integrated carrying case in a transition position, according to some embodiments.
Figure 1C:
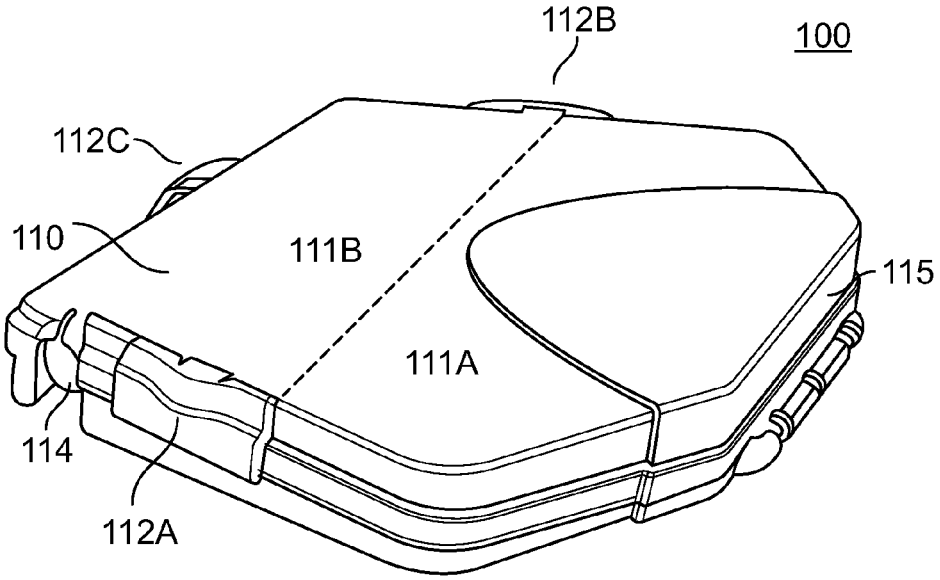
FIG. 1C is a perspective view illustrating a portable toilet adapter seat with an integrated carrying case in a closed position, according to some embodiments.

FIG. 1A includes a 3-dimensional perspective view of the travel potty 100 when open and ready for use by a potty training toddler, according to an embodiment. The travel potty 100 includes a carrying case 105 and an open-front folding seat 120. The travel carrying case 105 has a case lid 110 as a top surface and a case base 130 as a bottom surface. When in an open position, the folding seat 120 is unfolded use while the case lid 110 folds over the case bottom 130 to provide a back rest. FIG. 1B shows a transition back to the closed position of FIG. 1C. To wit, the folding seat 120 is folded into a catty-corner (or caddy-corner) position and the case lid 110 is opened up from the back rest position. Next, in FIG. 1C, the folding seat 120 has been rolled back into the base 130 using stationary hinge 114 and the case lid 110 has been rotated over the base using living hinge 115. The lid 110 is secured to the case base 130 by three fasteners (112A, B, C) which can be living hinges integral to the case base 130. The travel potty 100 can be composed of a variety of plastics, a variety of rubbers, other polymer products, and any other suitable material (e.g., polypropylene, or other lightweight materials). Components of the travel potty 100 can be molded in a single casting from a glossy or dull material. Components can be specially formulated sanitary materials.

Furthermore, a living hinge formed from a single mold enables rotation without having separate parts that can pinch a child.

II. Component Details of the Portable Toilet Seat Adapter

Figure 2A:
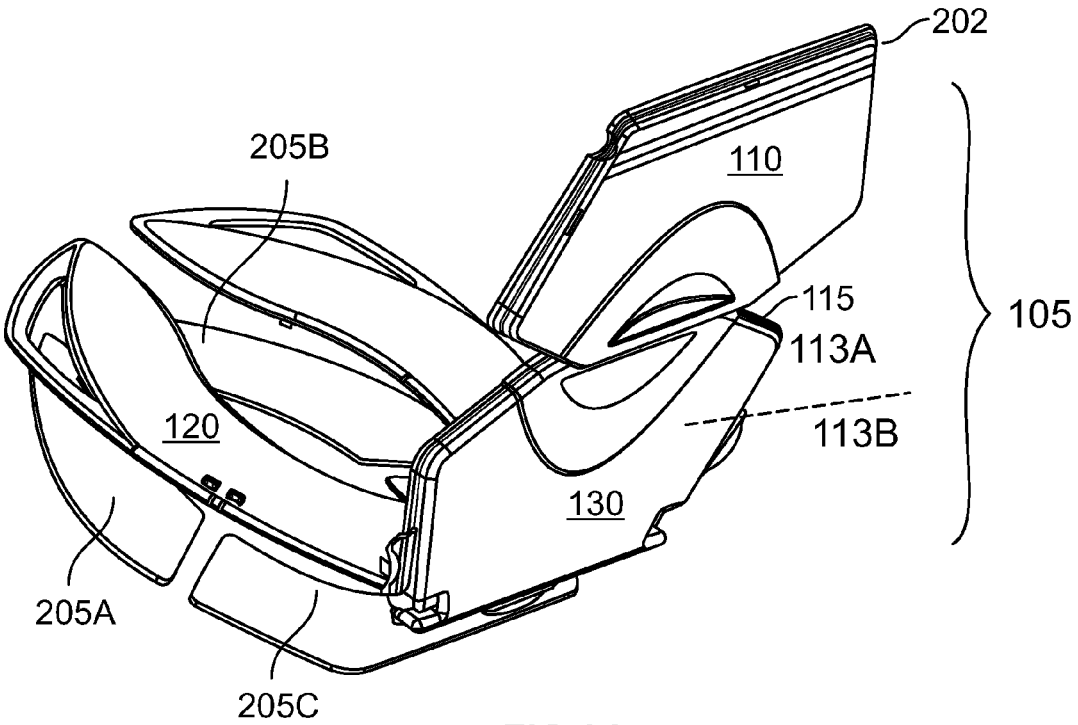
FIG. 2A-2A-1 are machine drawings of a perspective view and a top view of the travel potty, according to one embodiment.
Figures 1, 2A:
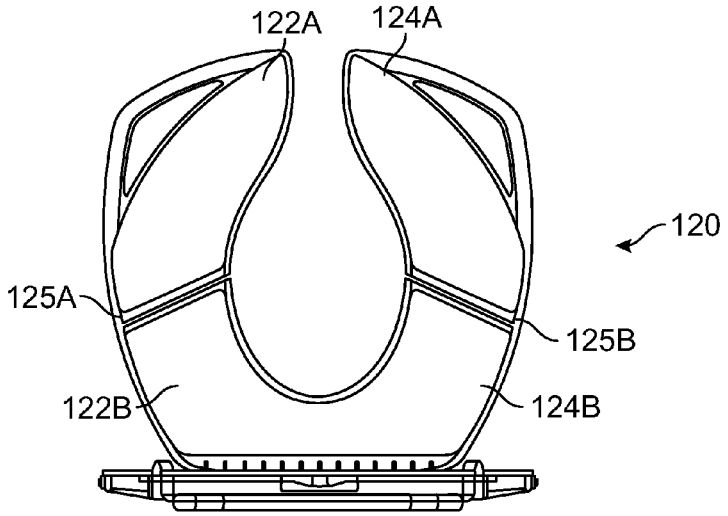

FIG. 2A includes machine drawings of a perspective view and a top view of the travel potty 100, according to one embodiment. The travel potty 100 is shown completely open, before the case 105 is folded over for use as a back support, or alternatively, after the case is opened in preparation to fold the travel potty 100. The top view shows the folding seat 120 components of a right living hinge 125A and a left living hinge 125B which separate a front portion of the folding seat 122A, 124A from a rear portion 122B, 124B on right and left sides, accordingly. In other embodiments, more compartments can be included in the case 105, leading to additional components that fold in for compactness. In still other embodiments, less compartments can be included, for example, just a folding seat 120 with a top that clamps down to maintain the closed position.

In some embodiments, the folding seat 120 in some embodiments is sized for a child and in other embodiment is standard size. Additional embodiments size the folding seat 120 to adapt to a conventional toilet seat while yet other embodiments adapt to a reduced size toilet seat, such as an airplane, train or bus toilet seat.

Figures 1, 2B:
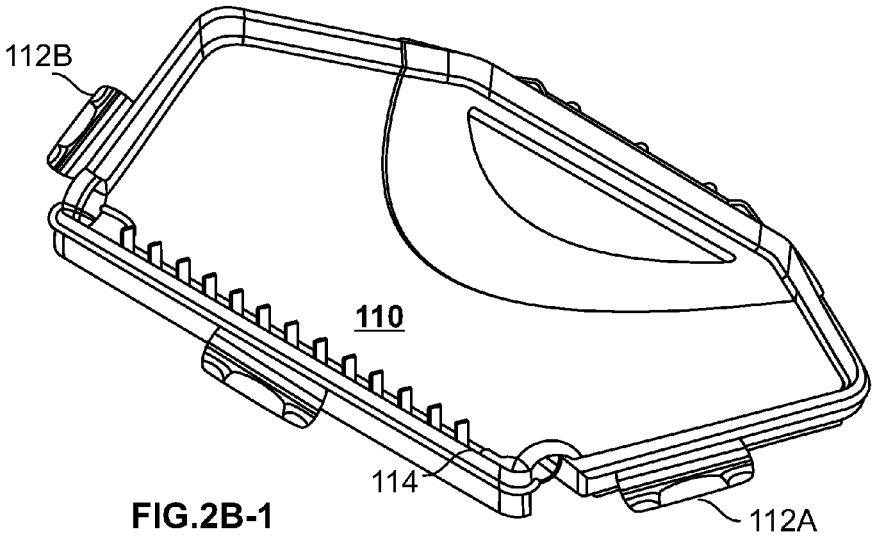
Figures 2, 2B:
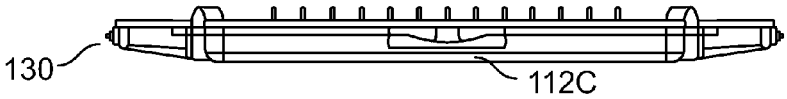

FIG. 2B includes a top view and side views of a case bottom 130 with hinges of the travel potty 100, according to one embodiment. The case bottom 130 is conjoined to the folding seat 120 on one end and a case lid 110 on the other end. When the folding seat 120 is in a folded position, the case bottom 130 supports the folding seat 120. In one embodiment, a depth of the case bottom 130 is compatible with a depth of the folding seat 120 when in a folded position.

Additionally, living hinge 115 built into the case bottom provides integrated rotation between the case bottom 130 and case lid 110. The living hinge 115 is like an elbow by allowing rotation while being integral with the case bottom 130 by being cast from a single mold. In one embodiment, a pinch free (or no pinch factor) case bottom 130 is cast from a single mold such that the living hinges are part of the mold casting. Accordingly, a plastic molding includes plastic hinges. The integral hinges are safer because they do not pinch the skin of a child while in use. In further detail, the hinges have fewer degrees of freedom than separate, independent hinges which are not so constrained. An independent screw, rod or other component would have more degrees of freedom which in turn allows skin to roll into spaces between the hinges and pinch children.

Figures 2, 2B, 3:
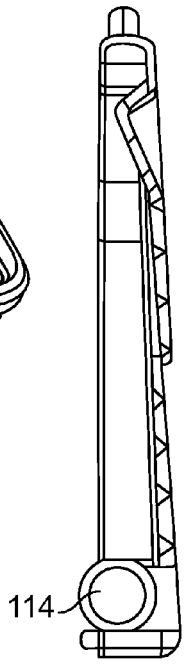
Figures 2, 2B, 3, 4:
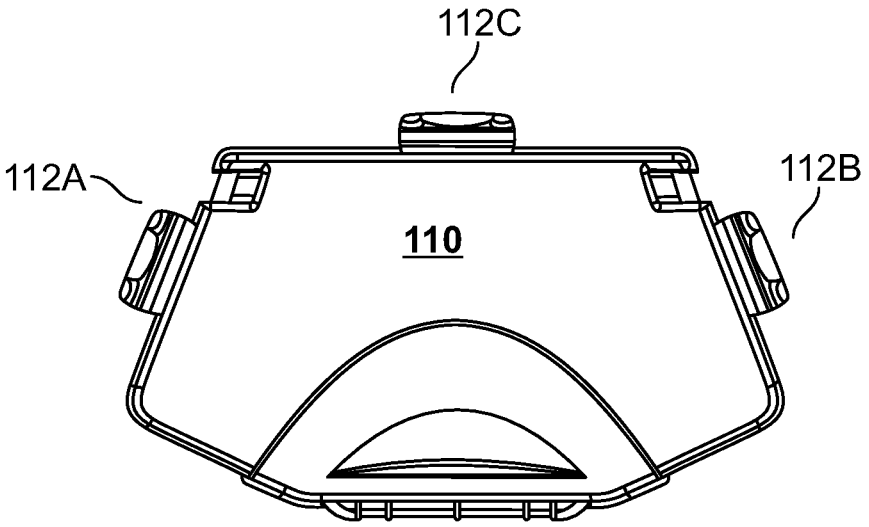
Figures 2, 2B, 3, 4, 5:
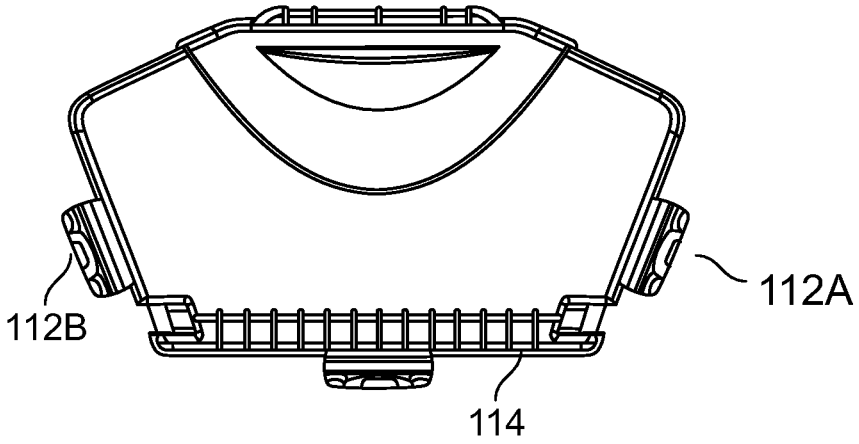
Figures 2, 2B, 3, 4, 5, 6:
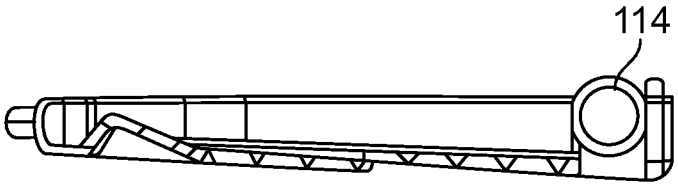
Figure 2C:
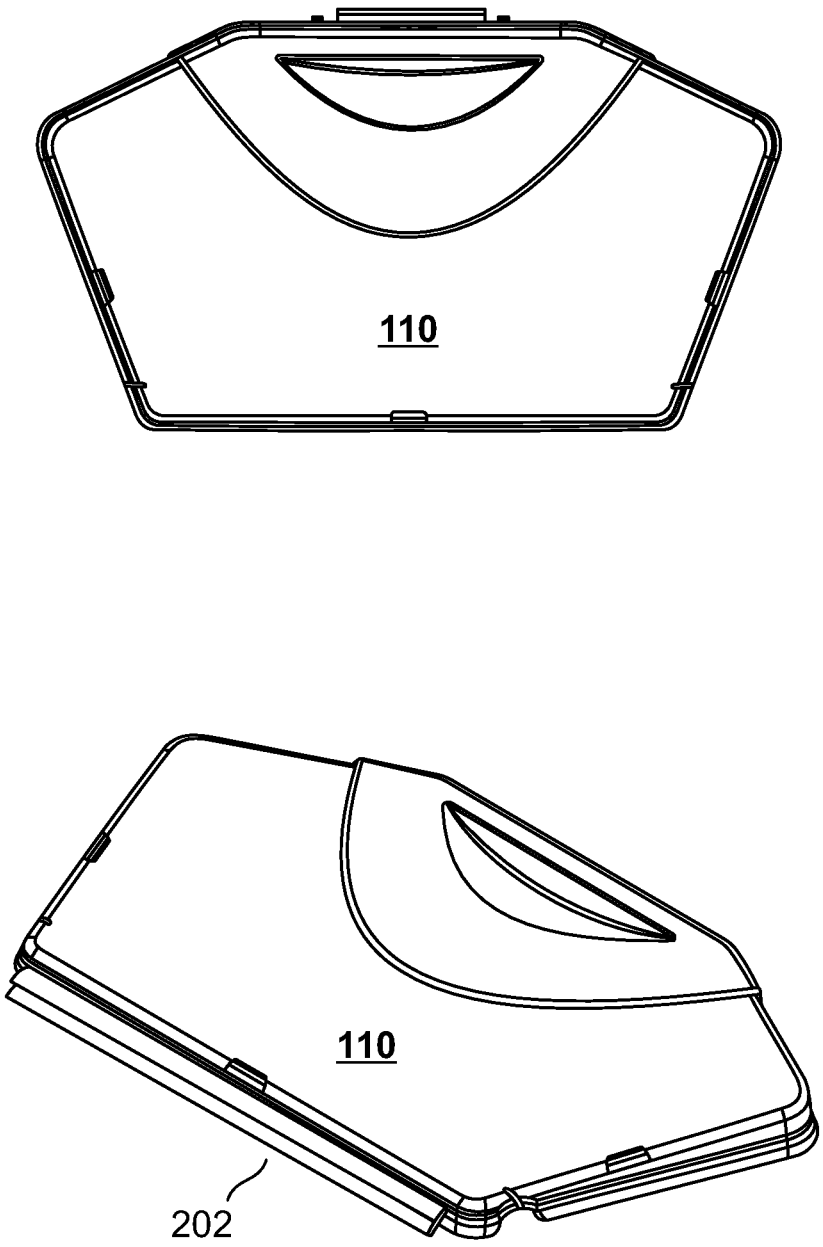
FIG. 2C are machine drawings of a top view and side views of a case lid of the travel potty, according to one embodiment.

FIG. 2C is a top view and side views of a case lid 110 and case bottom 130 of the travel potty 100, according to one embodiment. The case lid 110 is conjoined to the case bottom 130 on one end and the case lid 110 is not conjoined on the other end. When the folded seat is in a folded position resting in the case bottom 130, the case lid 110 closes to cover the folded seat. The end not conjoined can snap into a fastener also attached or snapped to the case bottom 130. As a result, the folded seat 120 is completely enclosed in the casing 105. The conjoined hinge supports one end of the closed travel potty 100 while the closed fastener supports the other end.

Figure 2D:
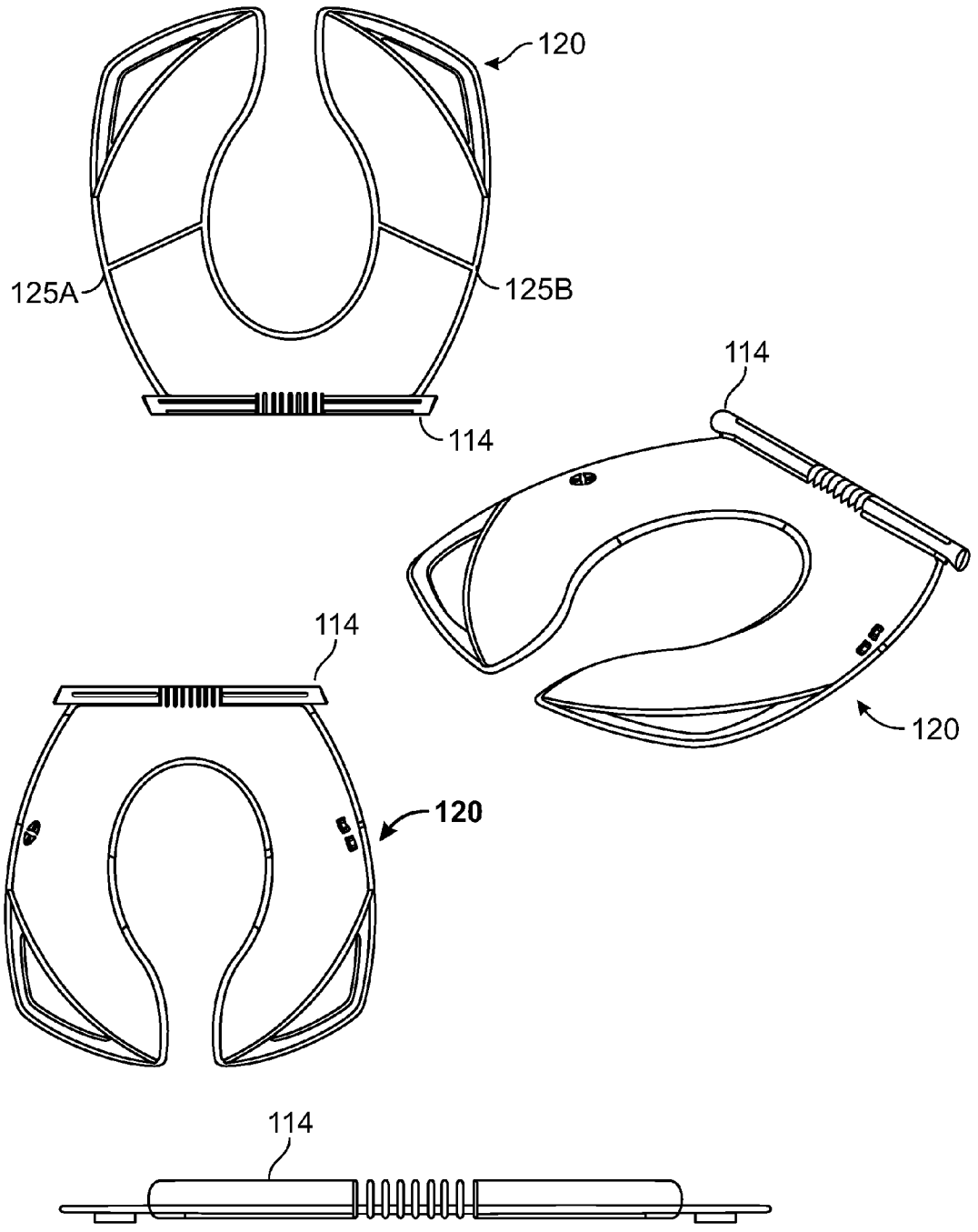
FIG. 2D are machine drawings of a top view and side views of a folding seat of the travel potty, according to one embodiment.

FIG. 2D includes a top view and side views of a folding seat 120 of the travel potty 100, according to one embodiment. The living hinges allow the seat 120 to fold catty corner for optimal reduction in size. Similar to a person folding their arms to touch opposite shoulders, sides protruding from a center of the folding seat allow a tip of a side to fold on top of the opposite side of a base. In the embodiment described in detail herein, the folding seat is tri-folded in a butterfly-like manner to reduce its size. However, other embodiments are possible that involve more or less folds. For example, an additional hinge along a base of the folding seat would allow a fourth fold to potentially reduce the travel potty size an additional 50% along the corresponding dimension. In one embodiment, a pinch free (or no pinch factor) folding seat is cast from a single mold such that the living hinges are part of the mold casting.

In some embodiments, the folding seat 120 also includes seat handles for sanitary self-support. The seat handles can be part of the single mold casting for the folding seat 120. Base hinges, which can also be living hinges, fasten the folding seat to the case bottom.

Figure 2E:
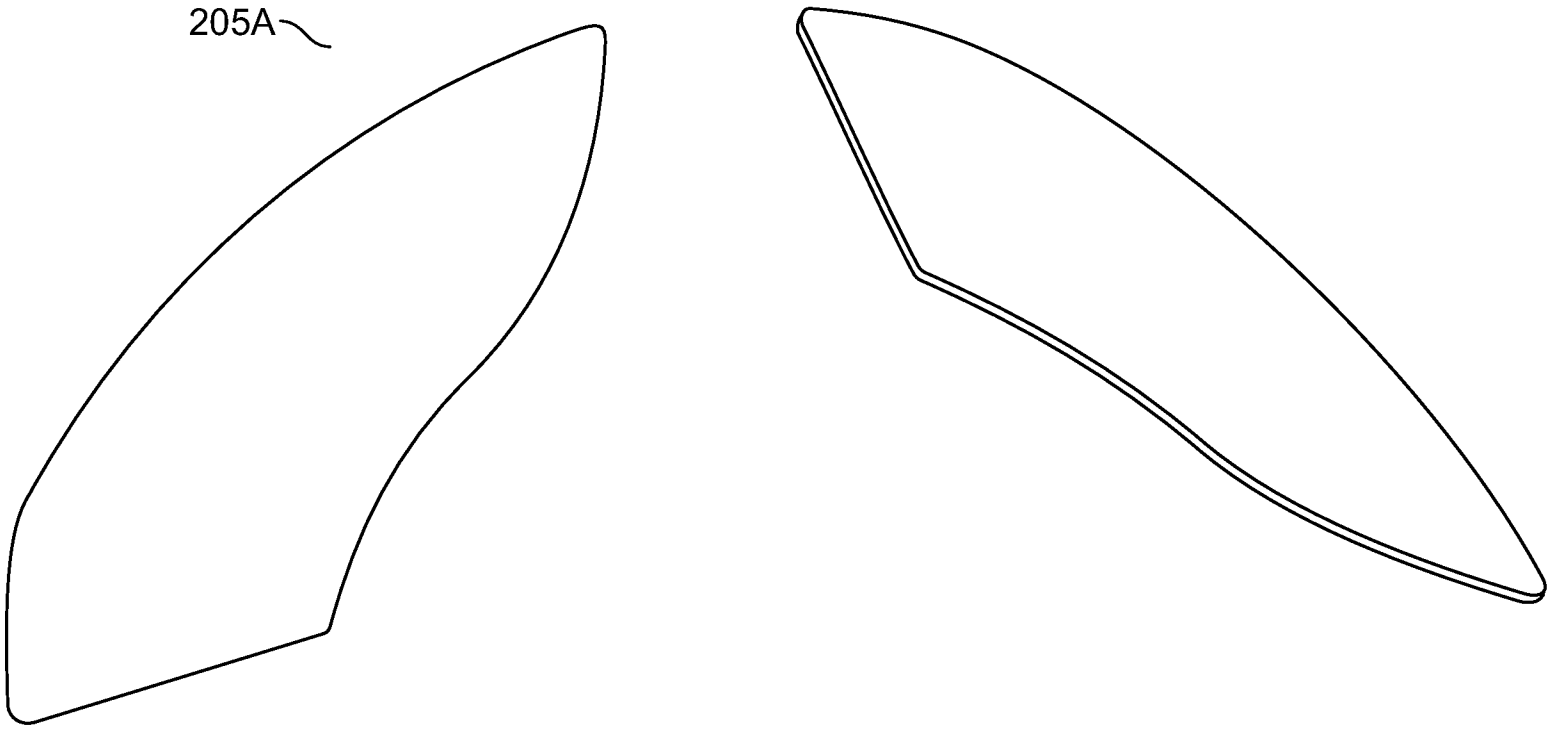
FIGS. 2E & 2F are machine drawings of a top view of a right pad and left pad of the travel potty, according to one embodiment.

FIG. 2E includes a top view of a right pad 205A of the travel potty 100, according to one embodiment. The right pad 205A can be composed of rubber or any other suitable material. The composition is chosen to provide surface friction between an underside of the folding seat and the conventional toilet seat. The right pad 205A is shaped for compatibility with one side of the folding seat 120.

Figure 2F:
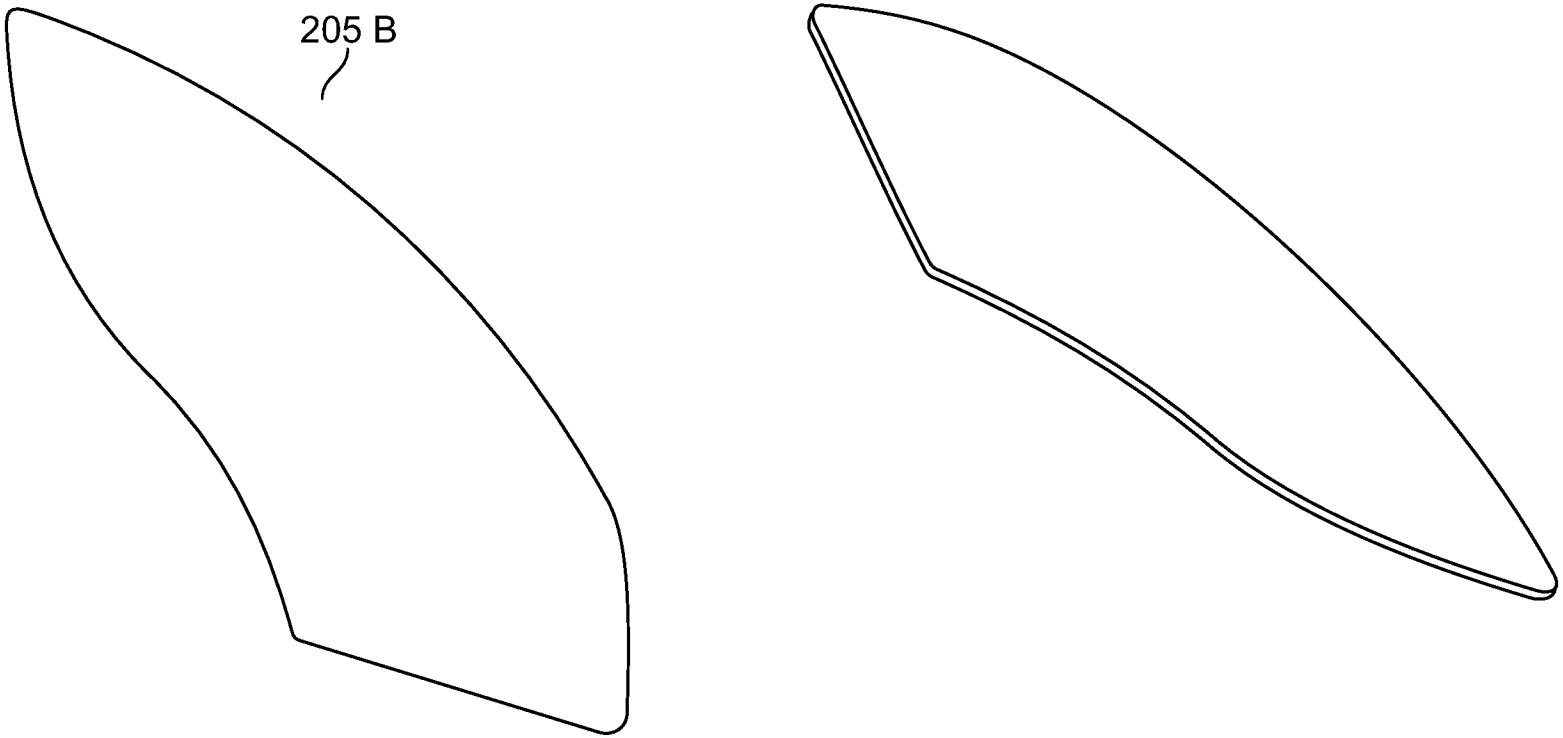

FIG. 2F includes a top view of a left pad 205B of the travel potty 100, according to one embodiment. The left pad 205B is preferably a mirror image of the right pad and compatible with an opposite side of a folding seat.

Figure 2G:
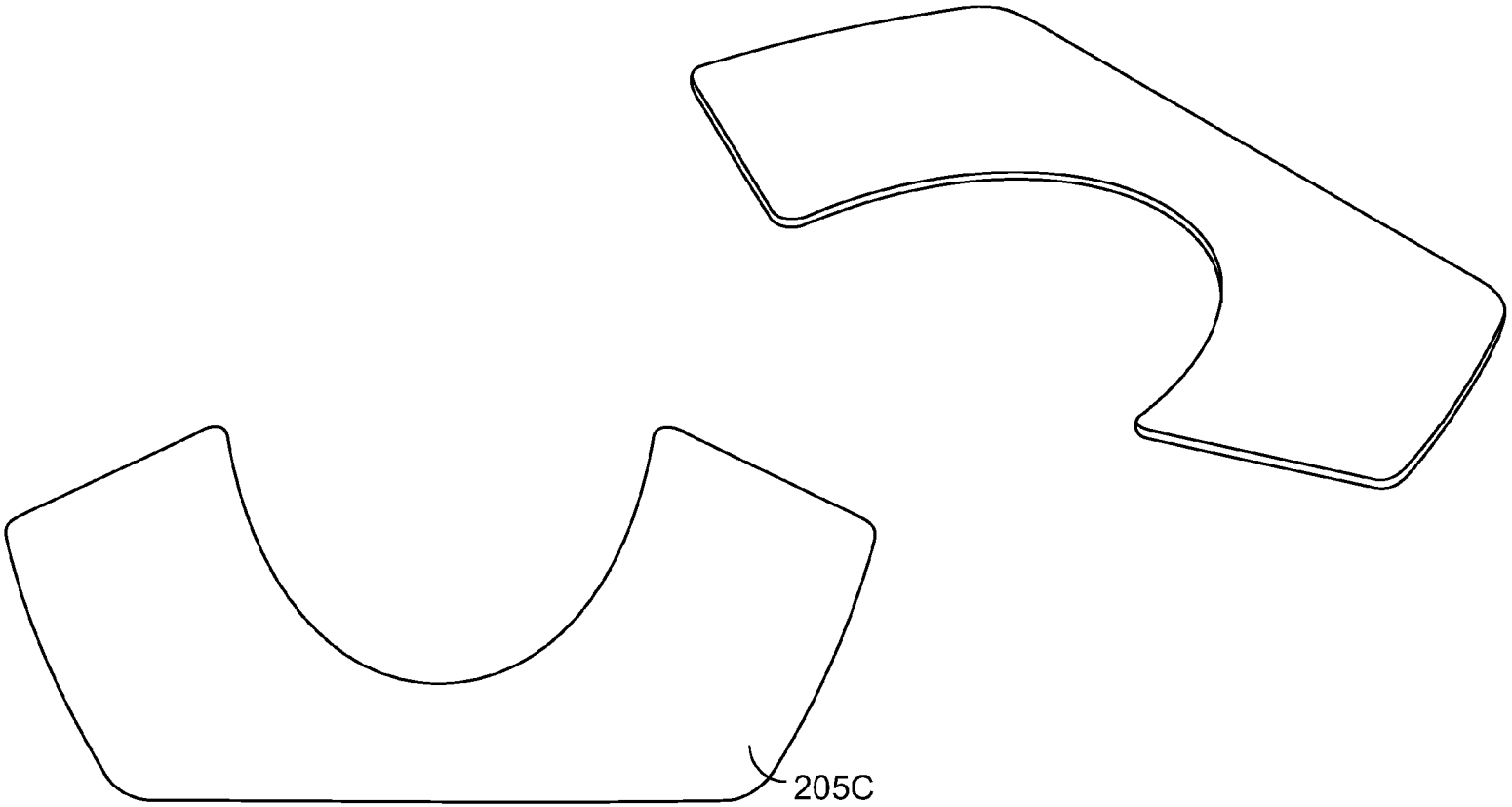
FIG. 2G is a top view and side view of seat and rubber padding, according to one embodiment.

FIG. 2G includes a top view of a center pad 205C of the travel potty 100, according to one embodiment. The center pad 205C is a base for the left 205A and right 205B pads, although the pads need not be touching. The center pad 205C corresponds in shape and size to the base of the folding seat.

Figure 2H:
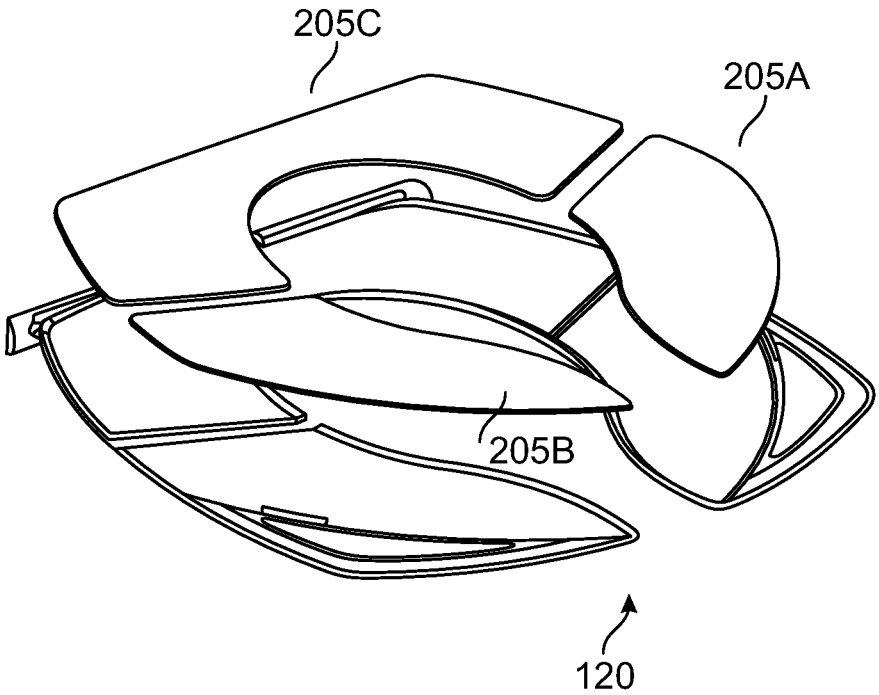
FIG. 2H is a top view and side view of seat and rubber padding, according to one embodiment.
Figure 2H:
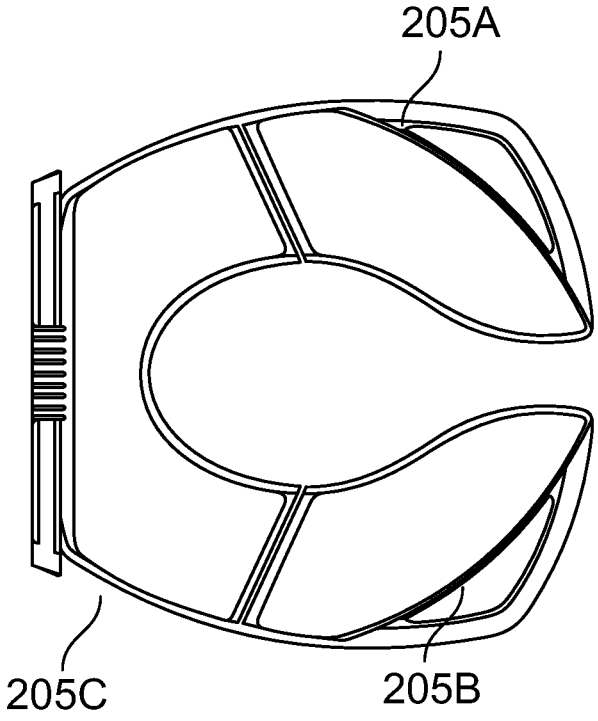
Figure 3:
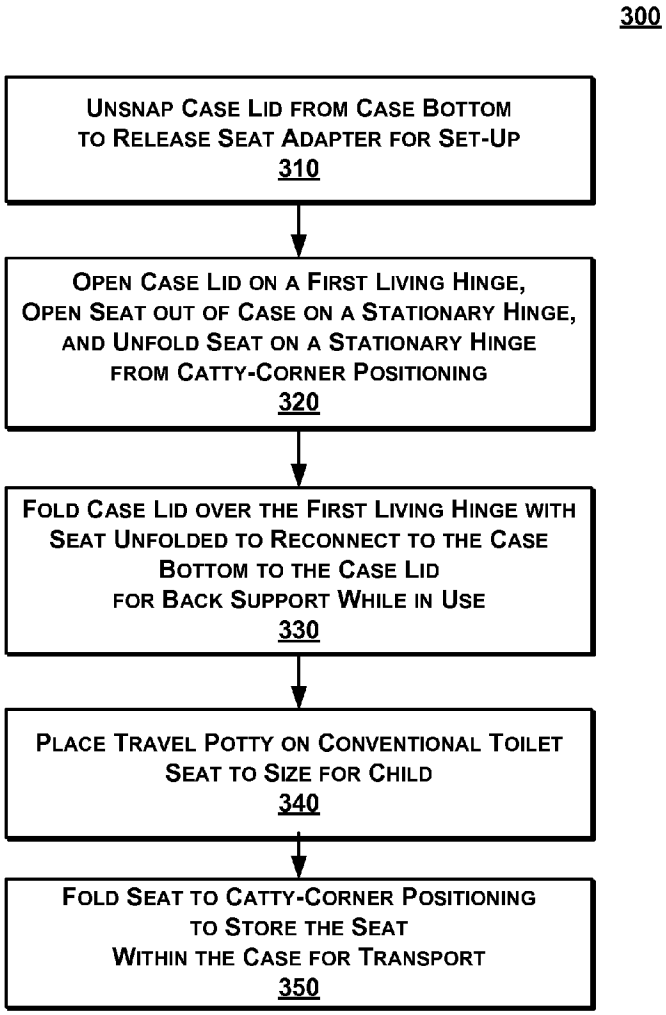

FIG. 2H is a top view and side view of seat 120 and rubber padding, according to one embodiment. As shown a rubber layer is broken into pieces according to the integral hinges. This removes a high stress region when the folding seat is in a folding position, and short circuits a related failure in the missing sections of the rubber layer. In some embodiments, however, the right, left and center pad are a single rubber piece.

Additionally, the left 205A, right 205B and center pads 205C are shown in position for attachment to the folding seat 120. Any type of glues or adhesives, fasteners, molding, or other suitable techniques can be utilized for supporting the attachment.

FIG. 3 is a flow chart illustrating a method 300 for deploying a travel potty (e.g., travel potty 100), according to one embodiment. In this particular embodiment, a case lid is unsnapped from a case bottom to release seat adapter for set-up (step 310). To do so, the case lid is opened on a first living hinge, the seat is opened out of a case on a stationary hinge, and the seat adapter is unfolded on a second living hinge from catty-corner positioning (step 320). The case lid is then folded over the first living hinge to reconnect he case bottom to the case lid for back support while in use (step 330). In some embodiments, the travel potty is placed on a conventional toilet set to size for a child (step 340). In other embodiments, standard size is maintained while a sanitary barrier is provided. For example, an airplane crew, dormitory students, and office employees that frequently use public facilities may wish to travel with or store a travel potty. Once complete, the seat adapter is folded to catty-corner positioning for storing the seat within the case for transport.

As will be understood by those familiar with the art, the invention may be embodied in other specific forms without departing from the spirit or essential characteristics thereof. Likewise, the particular naming and division of the portions, components, functions, procedures, actions, layers, features, attributes, methodologies, other aspects are not mandatory or significant, and the mechanisms that implement the invention or its features may have different names, divisions and/or formats. The foregoing description, for purpose of explanation, has been described with reference to specific embodiments. However, the illustrative discussions above are not intended to be exhaustive or limiting to the precise forms disclosed. Many modifications and variations are possible in view of the above teachings. The embodiments were chosen and described in order to best explain relevant principles and their practical applications, to thereby enable others skilled in the art to best utilize various embodiments with or without various modifications as may be suited to the particular use contemplated.

I claim:

1. A portable toilet seat adapter to fit over a stationary toilet during use, comprising:

a carrying case comprising:

a lid having a front and a rear, a base having a front and a rear, at least one fastener that couples the lid rear and to the base rear to close the carrying case, and a first living hinge that rotatably couples the lid front to the base front; and an open-front toilet seat in a U-shape, the open-front toilet seat comprising:

a front portion having an open end of the U-shape and fitting over a corresponding front portion of the stationary toilet seat, a rear portion having the closed end of the U-shape and fitting over a corresponding rear portion of the stationary toilet seat, a stationary hinge to rotatably couple the rear portion of the U-shape to the base of the carrying case, and at least a second living hinge to allow the open-front toilet seat to fold in a catty-corner position to fit into the carrying case to close with the at least one fastener, the open-front toilet seat being larger than the carrying case when unfolded, wherein second living hinge is integral within the U-shape of the open-front toilet seat, each being formed from a single cast die mold.

2. The portable toilet seat adapter of claim 1, wherein the at least the second living hinge is integral within the U-shape of the open-front toilet seat.

3. The portable toilet seat adapter of claim 1, wherein the second living hinge is integral within the U-shape of the open-front toilet seat, each being formed from a single cast die mold between the front and rear portions of the open-front toilet seat and without spacing between the second living hinge and the front and rear portions of the open-front toilet seat.

4. The portable toilet seat adapter of claim 1, wherein the second living hinge is integral within the U-shape of the open-front toilet seat, each being formed from a single cast die mold between the front and rear portions of the open-front toilet seat and without spacing between the second living hinge and the front and rear portions of the open-front toilet seat and without spacing between a plurality of ribs that make up the living hinge.

5. The portable toilet seat adapter of claim 1, wherein the at least the second living hinge comprises:

a third living hinge on a first side of the U-shape of the open-front toilet seat between the front and rear portions; and a fourth living hinge on a second side of the U-shape of the open-front toilet seat between the front and rear portions.

6. The portable toilet seat adapter of claim 5, wherein the third living hinge allows the front of the first side of the U-shape to fold over to the rear of the second side of the U-shape in the catty-corner position, and the fourth living hinge allows the front side of the first side of the U-shape to fold over to the rear side of the first side of the U-shape in the catty-corner position.

7. The portable toilet seat adapter of claim 1, wherein the one or more fasteners allows the top portion rear and the bottom portion rear to be released when unsnapped to unfold the open-front toilet seat from the catty-corner position for use.

8. The portable toilet seat adapter of claim 1, wherein the first living hinge allows the carrying case to be closed while the open-front toilet seat is unfolded to form a back rest for the user.

9. The portable toilet adapter of claim 1, wherein the at least one fastener comprises at least one living hinge.

10. The portable toilet seat adapter of claim 1, wherein the U-shape of the open-front toilet seat is either oval or circular.

11. The portable toilet seat adapter of claim 1, further comprising:

sanitary rubber padding attached to a bottom of the open-front toilet seat that rests on the stationary toilet seat when in use.

12. The portable toilet seat adapter of claim 1, further comprising:

a carrying strap or a handle attached to the carrying case.

13. The portable toilet seat adapter of claim 1, wherein the carrying case is formed from a single mode.

14. The portable toilet seat adapter of claim 1, wherein the open-front toilet seat is sized for a child and the stationary toilet seat is standard-sized.

15. The portable toilet seat adapter of claim 1, wherein the open-front toilet seat is sized to fit the stationary seat, wherein the stationary seat is smaller than standard size.

* * * * *